United States Patent [19]

Bilton

[11] 4,168,200

[45] Sep. 18, 1979

[54] METHOD FOR CONTROLLING CALIPER AND EDGE AND CORNER DELAMINATION OF HARDBOARD

[75] Inventor: Gerald P. Bilton, Alpena, Mich.

[73] Assignee: Abitibi Paper Company Ltd., Toronto, Canada

[21] Appl. No.: 559,387

[22] Filed: Mar. 17, 1975

[51] Int. Cl.[2] ..... D21J 1/18

[52] U.S. Cl. ..... 162/127; 162/165; 162/186; 162/188; 162/194; 162/208; 162/225; 162/311; 162/322

[58] Field of Search ..... 162/183–186, 162/165, 188, 322, 208, 124, 266, 268, 225, 127, 194, 311; 428/531, 529

[56] References Cited

U.S. PATENT DOCUMENTS

| | | | |
|---|---|---|---|
| 1,288,158 | 12/1918 | Perry | 162/127 |
| 2,112,540 | 3/1938 | McAndrews et al. | 162/186 |
| 2,680,995 | 6/1954 | Frost et al. | 162/165 |
| 2,693,415 | 11/1954 | Schur | 162/322 |
| 3,256,138 | 6/1966 | Welch et al. | 162/124 |
| 3,386,879 | 6/1968 | Yan et al. | 162/127 |
| 3,802,965 | 4/1974 | Arledter | 162/311 |
| 3,988,183 | 10/1976 | Senn | 156/62.2 |
| 3,996,325 | 12/1976 | Megraw | 162/225 |
| 4,113,555 | 9/1978 | Nyrén et al. | 162/185 |

*Primary Examiner*—S. Leon Bashore
*Assistant Examiner*—Peter Chin
*Attorney, Agent, or Firm*—Stevens, Davis, Miller & Mosher

[57] ABSTRACT

This relates to the manufacture of wet process hardboard. The invention involves supplying additional heat curable resin to the mid-thickness regions of the panel by injecting additional resin into the moving mat as it is being formed on a forming surface. The region of injection of the resin is selected so that the bottom of the partially formed mat is sufficiently consolidated to resist the passage of resin therethrough while at the same time the top of the mat is still sufficiently liquid so that disturbances of the fibers of the partially dewatered mat caused by the injection of the resin have an opportunity to mend. The resin may be injected into the longitudinal marginal portions of the mat in continuous fashion such that, after the edges of the final board product have been trimmed, the resin treated areas are exposed to view. The additional resin reinforces the edge portions and assists in providing uniform caliper of the board across its width. The resin may also be injected intermittently so that the resin-treated areas coincide with the corner portions of the mat after it has been cut to length thus reinforcing and assisting in providing uniform caliper as between the central portions of the board and the corner portions. In a further variation, the resin may be injected into the moving mat along lines spacedapart to coincide with the lines of cut of saws used to produce narrow strips of panelling which are later fabricated into lap siding. Each narrow board product ultimately produced has additional resin along its marginal edges and thus has additional strength and resistance to moisture penetration thus making it particularly useful for lap siding and the like.

8 Claims, 6 Drawing Figures

METHOD FOR CONTROLLING CALIPER AND EDGE AND CORNER DELAMINATION OF HARDBOARD

This invention relates to improvements in the manufacture of wet process hardboard panelling.

As is well known in the art, the process of manufacturing hardboard includes the steps of preparing the fibre (usually including steam cooking and mechanical refining), washing and chemically treating the furnish (by way of binding resins, sizes, pH adjusting chemicals), forming a wet fibrous mat by draining an aqueous suspension of the furnish, partially dewatering the mat by cold pressing, hot pressing the cold pressed mat on a wire screen (using a patterned top caul plate in the press where surface embossing is desired), post baking and re-humidifying the hot pressed board in ovens and humidifying chambers, and then cutting to size and finishing as required.

One long standing problem in hardboard manufacture concerns the tendency for the board to be "bowl" shaped in caliper profile. That is, the board has a tendency to be thicker on its outside edges with the thickest points being the four corners of the pressed board. The reasons for this may be explained as follows: In pressing, the board is compressed to below the desired caliper. On release, it springs back a certain degree due to the natural resilience of the wood fibre. The amount of spring back is limited by the curing of the natural bonding agents in the wood and the phenolic resin which is commonly added to reinforce the natural agents. These bonding agents are cured under heat and pressure and bind the wood fibres together, preventing the sheet from returning to its original caliper. An insufficiency of heat near the edges of the press platens prevents these bonding agents from being cured as well as in the center of the mat, i.e. heat loss from the platen edges and the flow of water out of the wet board edges causes the heat input per unit of board area to be less at the edges then it is at the center of the mat. Consequently, the fibres spring back more at the corners and edges, creating the "bowl" shaped caliper profile. The shorter the pressing time and the closer the mat edge is to the platen edge, the greater the caliper difference between corners and centers.

By way of example, using minimum press cycle time on ¼ inch hardboard, the corner caliper might be 0.055 inches greater than the center caliper, e.g. center caliper could be 0.210 inches and corner caliper 0.265 inches thus taking up the entire commercial thickness tolerance within one board. Any further reduction in press cycle time thus could not be tolerated without exceeding the commercial tolerance. In addition the middle portions of the corner and edge parts of the board tended to be soft and "punky" and delamination of the board in these regions usually commenced before the commercial tolerance variations were exceeded, thus necessitating a return to a longer press cycle.

It has been known in the art for a long time that an increase in the total amount of phenolic resin in the board reduces board caliper. Thus, if enough phenolic resin is used, theoretically enough of the resin can be cured, even at relatively short press cycle times, to keep "spring back" within acceptable limits. However, in practice, increases of as much as 75% in the total amount of phenolic resin added did not solve the problem outlined above and, in any event, the extra costs incurred by using increased amounts of phenolic tend to make the process uneconomic. This is perhaps not surprising since the problem areas in the board are confined, in a typical case, to the center one-third of the board thickness in the regions at the corners and edges of the board, the corners being by far the greatest problem areas and involving a total area less than one square foot in size as compared with a total board area of some 64 square feet. Thus, solutions designed to increase the overall phenolic content of the board are highly likely to be most uneconomic since the problem areas of the board are small in size as compared with the overall board size.

Other prior art attempts to overcome the above noted problems involved spraying or pouring extra resin on the freshly formed sheet over the suction boxes. These efforts failed because the low pH of the mat caused the resin to be promptly precipitated, thus causing it to be filtered out on or near the upper surface, and not sucked in to the mat as intended. Hence, the critical mid thickness portion of the board at the corners and marginal edges received no increase in resin.

In accordance with one aspect of the present invention, it has been found that additional resin can be supplied to the critical mid-thickness regions of the panel by injecting additional resin into the moving mat as it is being formed on the forming surface. The region of injection of the resin is selected so that the bottom of the partially formed mat at that point is sufficiently consolidated or tight as to resist the passage of precipitated resin while at the same time the top of the partly formed mat is still sufficiently liquid so that any disturbances of the fibres of the partially dewatered mat caused by the injection have an opportunity to mend.

In a typical application of the invention, resin injecting means, such as nozzles, are positioned adjacent the marginal edges of the mat forming surface in such a way as to penetrate into the partially formed mat. The nozzles are designed to apply the resin to a narrow strip, perhaps in the order of 2 inches wide or thereabouts, adjacent each side of the mat, and the nozzles are adjusted as to depth and the rate of flow of resin maintained at a value related to the rate of movement of the mat as to ensure good penetration of the resin into the critical portions of the mat being formed.

As noted previously, the corner of the board represent the worst problem areas at least partly due to the fact that the corners are exposed to the greatest amount of abuse during subsequent handling of the board. Thus, in an effort to minimize the quantity of resin used, the narrow strips of resin may be intermittent i.e., non-continuous in nature and positioned to coincide with the corner portions of the mat after the mat has been cut to length. This can be accomplished by installing a timer on a valve leading to the injection nozzles, the timer being synchronized with the speed of the forming machine so as to inject resin for about one or two feet of travel every 16 feet (in the case of 16 foot mats), the injected areas coinciding with the corners of the mats when the mat is cut to length. This aspect of the method limits the use of the extra resin to the critical corner areas and is very useful in times of high resin prices.

For optimum product quality, however, it is preferred that the resin be injected continuously adjacent the marginal edges of the mat during forming, with the narrow strips of resin coinciding with the lines of cut of the edge trim saws which trim off the longitudinal edges of the final board product to produce a finished panel.

In this case, the regions into which the additional resin has been injected are at the extreme outer edges of the product thus providing a board having substantially uniform caliper and greatly increased resistance to delamination all along its longitudingl marginal edges.

Thus far, the invention has been described in relation to the problems of caliper profile and corner and edge delamination. It has been discovered that a variation of the invention may be employed to improve the quality of certain narrow panel products, such as exterior lap siding.

In the manufacture of lap siding a medium density hardboard is formed as described previously. The hardboard panel, usually of a 4 foot nominal width by 16 foot length, is then cut into 12 inch wide strips for fabrication into 12 inch by 16 foot lap siding for exterior use. It is well known that the lower or "drip edge" of the lap siding is a critical region of the siding insofar as long-term weather resistance is concerned, and swelling and checking of such edge of the siding presents a problem in many cases.

Thus, in accordance with a further aspect of the invention, additional resin is injected into the mid-thickness regions of the moving mat along lines spaced apart to coincide with the lines of cut of the saws used to produce the narrow strips of panelling which are later fabricated into lap siding. As described above, the resin is injected in regions of the mat where the bottom of the mat is sufficiently consolidated as to resist the passage of resin therethrough with the top of the mat being sufficiently fluid so that any disturbances of the fibres of the partially dewatered mat have an opportunity to mend. The mat is then hot pressed in conventional fashion, baked and humidified and then sawed into strips with the lines of cut of the saws coinciding with the narrow strips of injected resin. The extra strength and resistance to moisture penetration reduces edge swell and checking in the final product as well as reducing edge damage during fabrication and subsequent handling of the product.

The principles of the invention will be further understood from the following description wherein reference is had to drawings wherein.

Figure 1:
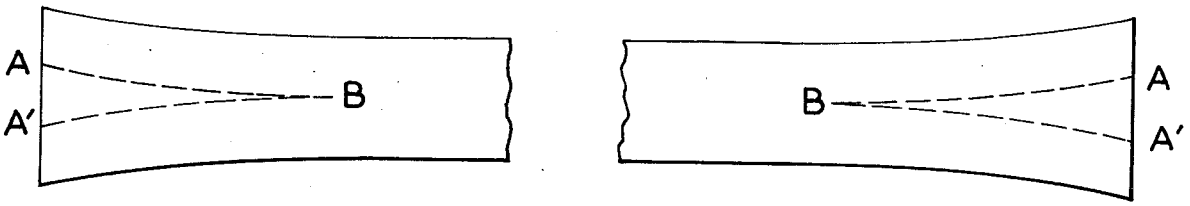
FIG. 1 is a typical corner caliper profile and cross-section of wet process hardboard pressed at minimum press cycle illustrating one of the problems of the prior art.

With reference to FIG. 1, one of the problems discussed above in relation to the prior art is illustrated. A study of board pressed at minimum cycle time showed that most of the spring back occurred in the triangular section bounded by lines A,A', B. The distance A,A' was approximately one third of the total edge caliper, and point B was approximately 6 inches from the edge of a 50 ¼ inch wide sheet pressed on a 54 inch platen. The triangular section of the board was also soft and "punky". Cure and springback on the top and bottom thirds i.e., above and below the triangular area seemed to be about as good as the complete cross-section in the center of the sheet. Accordingly one objective of the method is to supply additional resin to sections A, A', B on both edges of the sheet.

As is well known in the art, hardboard is made by first reducing wood chips to pulp by steaming, defiberating, and refining. Phenolic resin is added to the pulp and precipitated by the addition of alum or ferric sulfate. This pulp mixture is then pumped to the headbox 12 of the forming machine 10 shown in FIG. 2. At that point, the pulp mixture will normally range from 97% to 99% water.

This pulp flows onto a travelling screen 14 where it forms a pool 16 restrained on the edges by deckles 18 and gradually reduces in depth down the length of the screen as the water drains away, eventually leaving a continuous fibrous but still very wet mat. The point at which free water disappears from the surface of this mat is known as the water line.

The process of mat formation starts immediately upon the pulp slurry encountering the forming machine screen 14. Water draining through the screen 14 causes an increase in the fiber content of the pool immediately above the screen. The consistency and thickness of this strata gradually increase during the forming process until all free draining water is gone. The rate at which water drains through decreases steadily during the forming process as the increased consistency and thickness of the mat offers more and more resistance to the passage of water.

Figure 2:
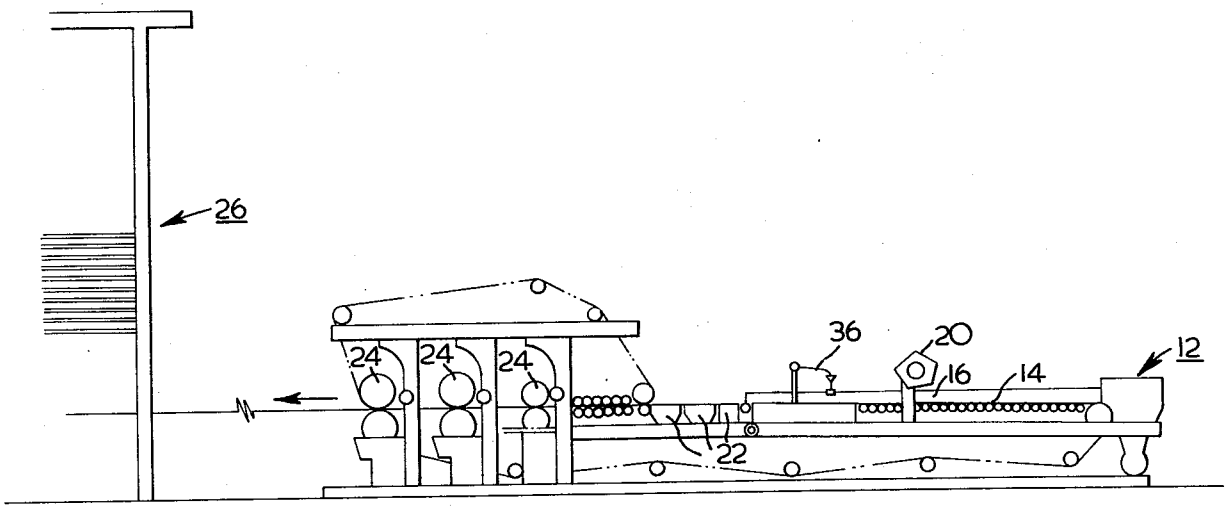
FIG. 2 is a side elevation view of the wet end of a hardboard forming machine incorporating the principles of the present invention.

It is common in hardboard formation for some sort of agitator to be provided to stir or pat the surface of the forming pool to smooth out fiber lumps. One name for this device is the "puddler" and is shown in FIG. 2 as item 20. It may be located anywhere between the headbox 12 and the water line but is typically set about midway between them.

Immediately after, or at the water line, the screen 14 passes over one or more suction boxes 22 which suck more water from the mat. A second headbox may be provided over one of these boxes to deposit a layer of finer fiber on the mat surface as is well known in the art.

After leaving the suction boxes 22, the mat passes between press rolls 24 to squeeze out more water. Moisture content after these rolls, is typically 60% to 70%. At this point a continuous length of paper (not shown) may be applied to the surface of the mat. The paper overlay, it should be understood, does not form a part of the present invention.

The mat is then cut to appropriate length, placed on a piece of screen wire, and conveyed to the hardboard press 26. There the mat is pressed between platens which are typically heated to temperatures in the order of 400° F. Part of the remaining water is squeezed out and the rest evaporated. The combination of heat and pressure converts the wet fibrous mat to hardboard. After pressing, the hardboard is heat treated, humidified and finished to saleable size.

Figure 3:
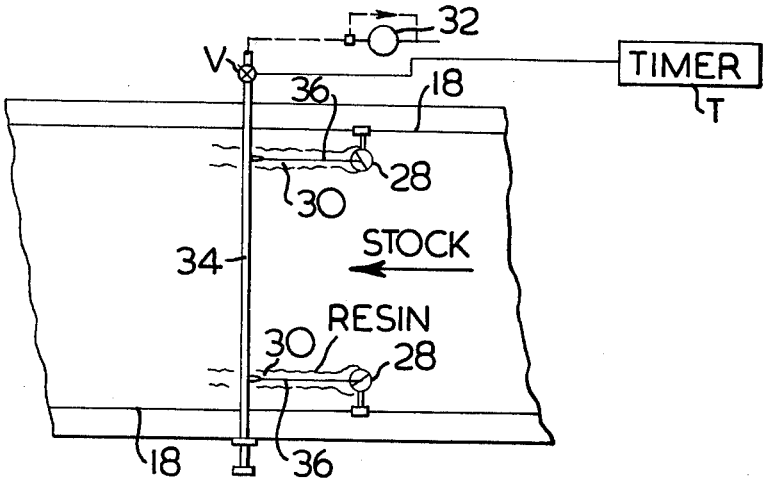
FIG. 3 is a plan view of a portion of the hardboard forming machine illustrating the injection of resin adjacent edge portions of the travelling layer of stock.
Figure 4:
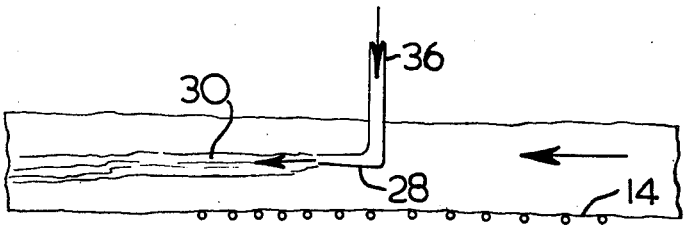
FIG. 4 is a somewhat diagrammatic view illustrating the injection of the resin into the mat being formed by means of a nozzle.

As generally described previously, the present invention, in one aspect, supplies additional resin to the critical mid-thickness regions adjacent the edges of the mat by injecting resin into the partially formed mat under pressure. The injection points are selected such that the bottom of the mat is sufficiently drained and the fibres compacted sufficiently to resist the passage therethrough of precipitated resin while at the same time the top of the mat is still sufficiently liquid enough or freely flowable to mend any fibre disturbance caused by the presence of the resin injection nozzles. The resin injection nozzles are designated by reference numerals 28 in FIGS. 3 and 4. Each nozzle is preferably positioned a short distance inwardly of the marginal edges of the mat being formed and each nozzle is disposed such that it extends into the body of the mat being formed, as seen in FIG. 4, whereby to inject the resin into the critical mid thickness section of the mat as discussed above. As shown in FIG. 4, the outlet of the nozzle 28 is disposed above the travelling screen 14 and is intermediate such screen and the upper surface of the stock, with such nozzle outlet being directed substantially in the direction of movement of the pulp stock as illustrated by the two generally horizontally directed arrows. Each nozzle 28 may have a generally fan shaped outline in plan or, alternatively may comprise a pair of spaced apart small pipes eg ⅛ inch in diameter, so as to inject the resin in the form of a strip or band 30 which, typically, may be in the order of 2 inches in width. The reason for positioning the nozzles inwardly of the marginal edges of the mat relates to the fact that these marginal edges are trimmed off the final board product by edge trim saws. Therefore, for maximum benefit to be achieved, the nozzles are located so that the outer limits of the bands of resin which are injected coincide with the lines of cut of the edge trim saws. Thus, in the final product, the regions into which additional resin has been injected are at the extreme outer edges of the product.

In order to supply resin to nozzles 28 a small positive displacement pump 32 may be used which is connected to nozzles 28 via supply header 34 and individual supply lines 36. Alternatively, a simple gravity head system may be used (not shown). In practice, the nozzles 28 may be adjusted outwardly or downwardly slightly to enable the resin to penetrate properly into the critical mid-thickness portions of the opposing edges of the mat.

EXAMPLE

In a typical example, nozzles 28 were positioned over a wet suction box 12½ feet from the headbox, 7½ feet after the puddler and 3½ feet ahead of the water line. The nozzles were located 3 inches inwardly from the opposing edges of the mat. The resin was injected continuously at a rate of 1.2 pints per minute and consisted of 41% solids by weight phenolic resin for each 2 inch wide strip, thus providing one continuous strip adjacent each side of the mat. The rate of machine travel was 58 feet per minute. This provides a 6½% by weight resin content in the 2 inch wide strips. The phenolic resin content of the pulp slurry at the head box was calculated to be about 0.71% by weight. Both of these weight percentages are based on the final dry weight of the board. Thus, the total resin used in the board was about 1.24% by weight or about 75% above the usual 0.71% by weight overall resin content used in the board prior to putting the invention into practice.

The properties of the final product were excellent. Edge caliper of the board was reduced by an average of 0.020 inches even after reducing the amount of time in the pressing cycle from seven minutes to six minutes. Corner delamination and soft core edges were eliminated. Trimming of the board was facilitated and edge damage was substantially eliminated.

In a previously mentioned modification of the invention, the resin is supplied intermittently so that the narrow strips of resin are spaced apart to coincide with the corner areas of the mat after it is cut. To provide this operation a timer T actuates a valve V in the supply header 34 to the nozzles 28. Timer T is synchronized with the speed of travel of screen 14 so as to inject resin during about one to two feet of screen travel for every 16 feet of screen travel. The mat is subsequently cut (by means not shown) into 16 foot lengths, the cuts intersecting the short resin strips with the result being that the extra resin content appears at the corner areas of the finished product.

Figure 5:
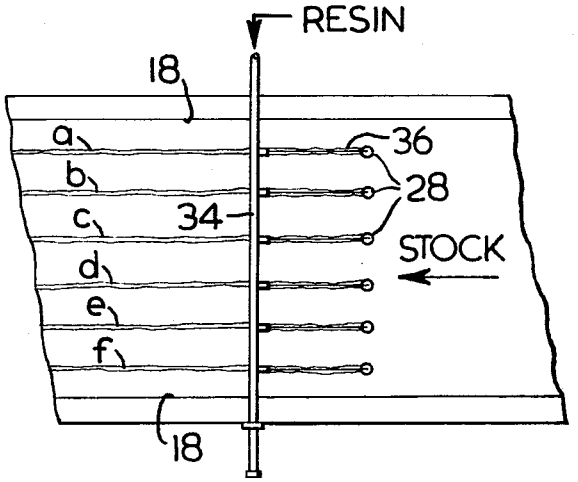
FIG. 5 is a view similar to FIG. 3 illustrating a separate aspect of the invention, FIG. 6 diagrammatically illustrates the cutting of a panel produced in accordance with the method of FIG. 5 into lap siding strips.
Figure 6:
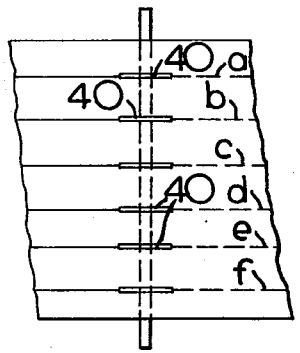

FIGS. 5 and 6 illustrate the previously described variation of the invention used to improve the quality of narrow panel products, such as lap siding panels. The mat is formed as described previously on a moving screen. The resin injection technique is also basically the same as described in connection with FIGS. 1-4. However, instead of using only two injection nozzles, a plurality of nozzles 28 are provided, spaced apart across the width of the mat so as to provide narrow bands of resin a, b, c, etc., which narrow continuous bands of resin coincide with the lines of cut of the saws on the completed panel to produce the narrow strips of panelling which are later fabricated into the lap siding. The mat is then pressed, baked and humidified as described previously.

The cutting technique is shown in FIG. 6 wherein spaced apart saws 40 cut the panel along the lines of cut corresponding to the narrow bands of resin a, b, c, etc. By cutting along the center lines of each resin reinforced strip of panel, extra strength, durability and moisture resistance are provided on both edges of each of the narrow panel pieces thus provided. Each panel piece is then further processed in a suitable fashion, which need not be described here, to produce a finished product.

While phenolic resin (phenol formaldehyde) has been described herein for use in the several forms of the process, those skilled in the art will appreciate that other forms of heat curable binders or resins may be used without departing from the principles of the invention. Typical examples of such heat curable binding agents are urea formaldehyde and melamine formaldehyde as well as certain polyurethanes and acrylics.

I claim:

1. The method of manufacturing wet-process hardboard including the steps of:

(a) flowing a layer of pulp stock on to a moving forming surface and dewatering said pulp as it is moved along by said surface to form a partially dewatered mat of pulp fibers (b) adding a heat curable binding agent to the pulp by injecting the binding agent into and exclusively within generally mid-thickness regions of the moving pulp stock in the general direction of movement of the moving pulp stock; said binding agent being injected at locations which are spaced apart transversely relative to the mat so that the binding agent becomes relatively more concentrated in correspondingly spaced apart, longitudinally extending, narrow strip-like generally mid-thickness regions of the moving partially dewatered mat intermediate the upper and lower surfaces of the mat, (c) the binding agent being injected into the mat at a position along the moving forming surface where the mat bottom is sufficiently consolidated as to resist the passage of said binding agent therethrough while the top of the mat is still sufficiently liquid as to permit any disturbances of the fibres to mend before the mat formation is completed, and (d) thereafter further dewatering and hot pressing the mat to consolidate the fibres of the mat and form a hardboard having increased bond strength between the fibres in said strip-like mid-thickness regions where the binding agent is relatively more concentrated.

2. The method according to claim 1 wherein the binding agent is injected at locations adjacent the marginal edges of the mat and also at transversely spaced apart locations between said marginal edges to distribute the binding agent in said correspondingly spaced apart longitudinally extending strip-like regions, and wherein, after forming of the hardboard, the hardboard is cut along lines corresponding to each of the narrow strip-like regions to produce a plurality of narrow hardboard products having longitudinal edges possessing increased strength and resistance to moisture penetration by virtue of the injected binding agent.

3. A method according to claim 1 wherein said binding agent comprises phenol formaldehyde resin.

4. The method according to claim 1 wherein said locations where said binding agent is injected are adjacent the longitudinal marginal edges of the mat thereby to provide each longitudinal marginal edge region of the mat with one said strip-like region having the injected binding agent therein with said injected binding agent serving to offset the effects of heat losses occurring adjacent the longitudinal edges of the mat during the hot pressing and provide more uniform thickness across the pressed hardboard and greater strength along said longitudinal marginal edges and to reduce the possibility of delamination occurring.

5. The method according to claim 4 wherein the longitudinal edges of the complete hardboard are trimmed off by saw means or the like, and said strip-like regions of the mat into which the binding agent has been injected are disposed such that the outer limits of said strip-like regions are at the extreme outer edges of the trimmed hardboard.

6. The method as claimed in claim 5 wherein said binding agent is injected continuously during movement of the mat whereby said strip-like regions of the mat into which the binding agent has been injected extend along the full lengths of said longitudinal marginal edges.

7. The method as claimed in claim 5 wherein said binding agent is injected in intermittent fashion in timed relation to the movement of the mat so that said strip-like regions having the injected binding agent therein are located in areas coinciding with the corners of the mat after the mat has been cut to predetermined lengths.

8. A hardboard panel produced according to the method of claim 1.

* * * * *